United States Patent [19]

Taube, III

[11] Patent Number: 5,072,881

[45] Date of Patent: Dec. 17, 1991

[54] METHOD OF CLEANING AUTOMATED PAINT SPRAYING EQUIPMENT

[75] Inventor: Frank A. Taube, III, Troy, Mich.

[73] Assignee: Systems Specialties, Ferndale, Mich.

[21] Appl. No.: 532,638

[22] Filed: Jun. 4, 1990

[51] Int. Cl.[5] ..... B05B 15/02

[52] U.S. Cl. ..... 239/8; 239/112; 239/569

[58] Field of Search ..... 239/1, 8, 112, 113, 239/569; 118/302

[56] References Cited

U.S. PATENT DOCUMENTS

| | | | |
|---|---|---|---|
| 3,155,539 | 11/1964 | Juvinall . | |
| 3,169,545 | 2/1965 | Kolling . | |
| 3,179,341 | 4/1965 | Plos et al. . | |
| 3,348,774 | 10/1967 | Wiggins . | |
| 3,385,522 | 5/1968 | Kock . | |
| 3,450,092 | 6/1969 | Kock . | |
| 3,833,417 | 9/1974 | Griparis . | |
| 3,848,365 | 11/1974 | Bovensiepen et al. . | |
| 3,857,513 | 12/1974 | Wiggins | 239/70 |
| 4,178,134 | 12/1979 | Babish et al. . | |
| 4,265,858 | 5/1981 | Crum et al. | 239/112 |
| 4,311,724 | 1/1982 | Scharfenberger . | |
| 4,337,282 | 6/1982 | Springer . | |
| 4,348,425 | 9/1982 | Scharfenberger . | |
| 4,350,720 | 9/1982 | Scharfenberger . | |
| 4,375,865 | 3/1983 | Springer . | |
| 4,403,736 | 9/1983 | Scharfenberger . | |
| 4,509,684 | 4/1985 | Schowiak | 239/112 |
| 4,653,691 | 3/1987 | Grime . | |
| 4,787,404 | 11/1988 | Klosterman et al. . | |
| 4,813,603 | 3/1989 | Takeuchi et al. | 239/113 |
| 4,881,563 | 11/1989 | Christian | 118/302 |
| 4,902,352 | 2/1990 | Christian . | |

*Primary Examiner*—Andres Kashnikow
*Assistant Examiner*—Karen B. Merritt
*Attorney, Agent, or Firm*—Harness, Dickey & Pierce

[57] ABSTRACT

An improved method for cleaning or purging of automated spray painting or coating equipment is disclosed which significantly reduces the solvent and time required to change from one color or coating material to another. The method of the present invention utilizes a ratio mixing valve to intermix a compressed gas such as air and a liquid solvent in a predetermined ratio which is then passed through the manifolds and supply lines of the painting or coating equipment to effect a thorough and complete cleaning thereof thus readying the equipment for use of the next paint color or coating material.

4 Claims, 1 Drawing Sheet

METHOD OF CLEANING AUTOMATED PAINT SPRAYING EQUIPMENT

BACKGROUND AND SUMMARY OF THE INVENTION

The present invention relates generally to a method for efficiently and effectively cleaning a fluid flow control system and more particularly to such a method utilized for cleaning automated painting equipment such as is required between applications of different colors of paint.

In spray painting of various types of products such as for example automobiles, automated machinery has been developed for supplying a variety of different types and colors of paint to the same application devices (i.e. spray guns). In many of these applications, successive automobiles or parts therefore are to be painted a different color. In order to accomplish this color change, it is necessary to quickly purge the paint supply lines leading to the applicators or spray guns so as to avoid intermixing of the different colors. Presently, this purging operation is accomplished by alternately pulsing set quantities of air and solvent through the supply lines. While this procedure is effective in cleaning of the system, it would be desirable to reduce the time required for this operation. Further, this cleaning operation requires a substantial amount of solvent be utilized which solvent usage is coming under increasingly greater scrutiny and regulation by various governmental agencies due to its potential harmful effect on the environment.

The present invention, however, provides a very effective method of cleaning such fluid supply systems in a significantly shorter time frame as well as greatly reducing the volume of solvent required to accomplish such a cleaning operation. According to the method of the present invention, solvent and air are intermixed via an adjustable ratio mixing valve which then supplies the mixed air and solvent to the supply system. The ratio mixing valve is preferably of the type disclosed and claimed in applicant's U.S. Pat. No. 4,924,900 entitled "Adjustable Ratio Mixing Valve" and is capable of maintaining a predetermined ratio between two separate fluid supplies irrespective of changes in the pressure at which the fluids are being supplied.

The method of the present invention offers substantial cost savings in terms of significantly reduced solvent usage while also greatly assisting users thereof in complying with the increasingly stricter solvent restrictions.

Additional advantages and features of the present invention will become apparent from the subsequent description and the appended claims taken in conjunction with the accompanying drawings.

DESCRIPTION OF THE PREFERRED EMBODIMENT

Figure 1:
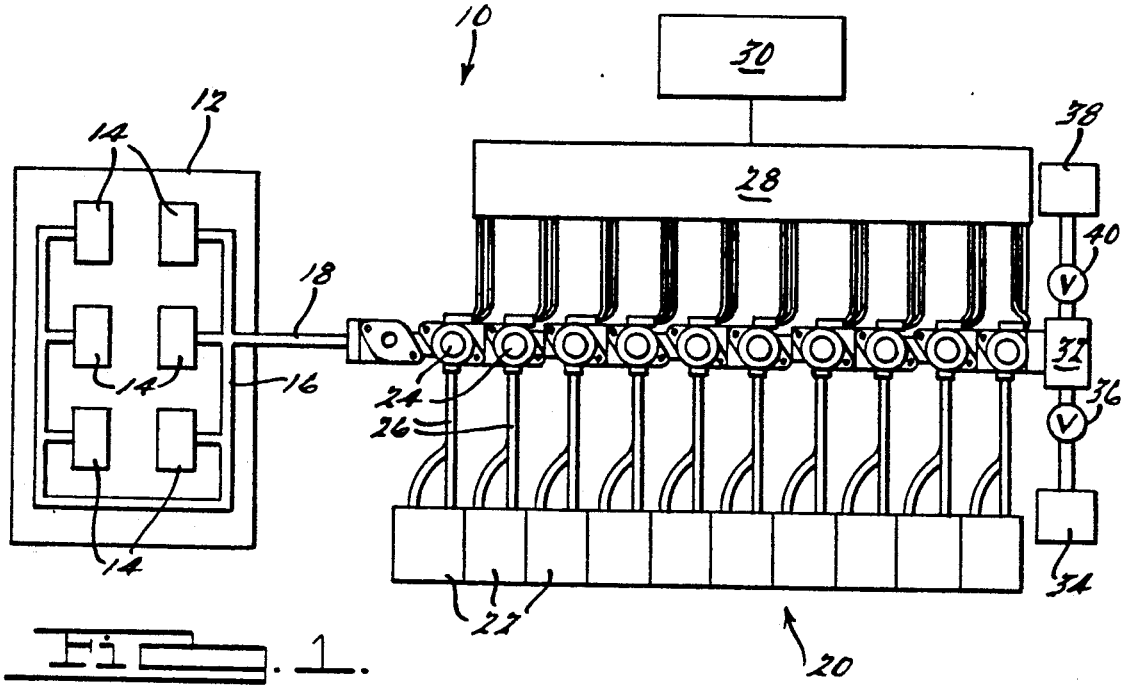
FIG. 1 is a schematic diagram illustrating a paint supply system incorporating valve and fluid supply means for system purging in accordance with the present invention.

Referring now to FIG. 1, there is shown in diagrammatic form a painting system indicated generally at 10 such as may be employed in painting of motor vehicles or the like. As shown, painting system 10 incorporates a spray booth 12 having a plurality of spray guns 14 positioned at various locations therein so as to expeditiously and efficiently paint a motor vehicle body or other article located within the spray booth. A manifold system 16 is connected between a supply line 18 and the respective spray guns 14 and serves to feed the desired color of paint thereto from a remotely located supply indicated generally at 20. The remotely located paint supply comprises a plurality of paint reservoirs 22 each of which contains a paint of a particular color. A plurality of pneumatically actuated valves 24 are positioned in a side-by-side manifolded relationship for supplying respective colors from reservoirs 22 via supply lines 26. A suitable supply 28 of actuating air and associated control means 30 is also provided for controlling operation of the valves 24. As thus far described, the above paint system is typical of those presently utilized in various painting operations. It will also be appreciated that when a valve 24 is actuated to an open position, a particular color or type of coating material or paint will flow under pressure from reservoir 22 to spray guns 14 via supply line 18 and manifold 16. Once the article has been fully coated, the valve 24 will close thereby stopping further flow of the coating material. However, supply line 18, manifold 16 and spray guns 14 will all still contain some of the paint or coating material and thus must be cleaned or purged prior to application of a different color.

In order to accomplish this task, an adjustable ratio mixing valve 32 is connected to one end of the manifolded valve assembly which end is opposite that to which supply line 18 is connected. A source of solvent 34 under pressure is connected to one inlet thereof along with suitable control valving 36 and a source of compressed air 38 is connected to the other inlet to valve 32 again with a suitable on/off flow control valve 40 coupled therebetween.

Figure 2:
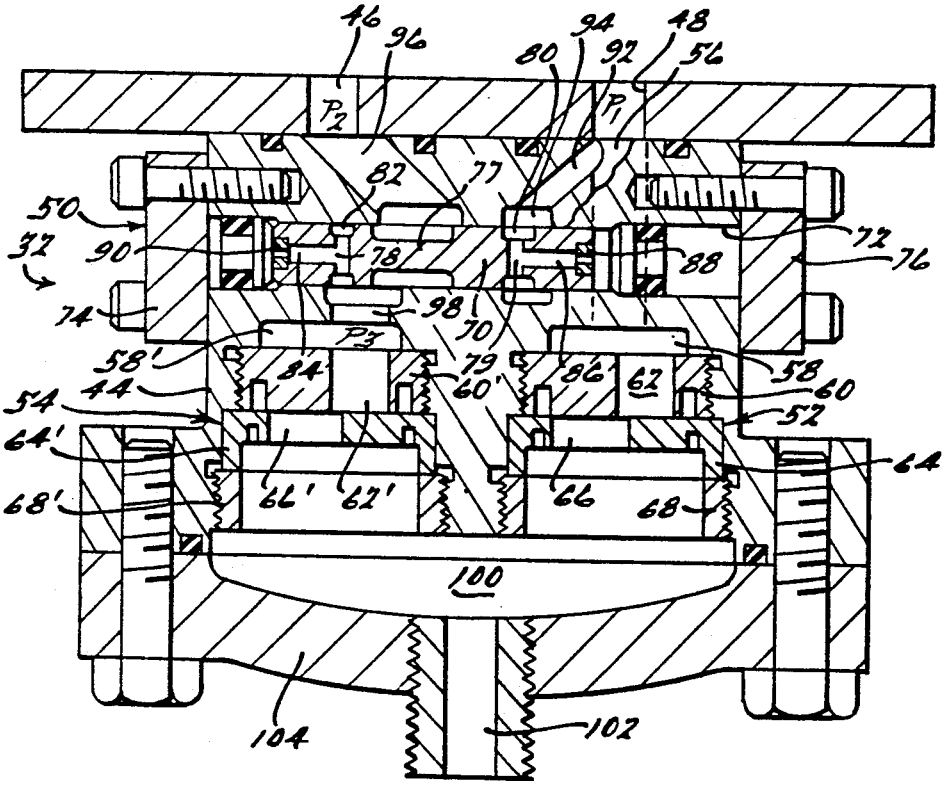
FIG. 2 is a section view of an adjustable ratio mixing valve for use in carrying out the method of the present invention.

As best seen with reference to FIG. 2, a valve 32 includes a housing 44 having fluid passage 56 extending from inlet 48 to a chamber 58 within which is disposed fixed orifice assembly 52. Fixed orifice assembly 52 comprises a first threaded plate member 60 having an eccentric opening 62 extending therethrough and a second plate member 64 also having an eccentric opening 66 extending therethrough positioned in partially overlapping relationship with eccentric opening 62 so as to define a fixed orifice flowpath therethrough. A threaded retainer ring 68 is also provided which serves to lock plate member 64 in the desired circumferential orientation as well as to retain it in a fluid-tight abutting relationship with threaded plate member 60.

Fixed orifice assembly 54 is substantially identical to fixed orifice assembly 52, corresponding portions thereof have been indicated by like numbers primed.

Variable orifice assembly 50 comprises a spool valve 70 movably disposed within a bore 72 extending laterally through housing 44. The opposite ends of bore 72 are sealed off by suitable closure members 74 and 76 each of which also includes a projection extending into bore 72 which operates to limit movement of spool valve 70. Spool valve 70 includes a reduced diameter center portion 77 and a pair of diametrically extending passages 78 and 79 adjacent opposite ends thereof which open outwardly into annular grooves 82 and 80. Centrally disposed axial passages 84 and 86 extend inwardly from opposite ends of spool valve 70 and open into respective passages 78 and 79. Inserts 90 and 88 are fitted within the outer ends of each of the axial passages 84 and 86 and have an orifice defining opening extending therethrough of a size smaller than the diameter of passages 84 and 86. A fluid passage 92 extends from passage 56 to an annular groove 94 provided in the sidewall of bore 72. As shown, annular grooves 80 and 94 are positioned relative to each other so as to assure fluid communication therebetween regardless of the axial position of spool valve 70.

Housing 44 also contains a fluid passage 96 extending from inlet 46 to one side of bore 72 and a second relatively short fluid passage 98 extending from the opposite side of bore 72 to chamber 58'. As shown, passages 96 and 98 open into bore 72 on diametrically opposed sides thereof and are slightly axially displaced from each other although both overlap and communicate with the space defined by reduced diameter portion 77. As spool valve 70 is moved to the right as shown in FIG. 2, it will be noted that the left sidewall of reduced diameter portion 77 will reduce the area of communication between passages 96 and 98 thereby increasing the pressure drop thereacross. Similarly, movement of spool valve to the left will increase the area of communication between passages 96 and 98 thereby decreasing the pressure drop across this thus defined variable orifice.

Openings 66 and 66' both open into a common discharge chamber 100 from which a single discharge port 102 opens outwardly for supplying the now mixed fluids for use in cleaning of the manifold valve passage as well as supply line 18, manifold 16 and spray guns 14.

In operation, once the painting operation has been completed, respective valves 36 and 40 will be simultaneously actuated to an open position thereby providing a supply of both solvent and compressed air to ratio mixing valve 32.

Thus solvent will be allowed to flow via inlet 48 at a pressure $P_1$ and compressed air to be mixed therewith will be allowed to enter inlet 46 at a pressure $P_2$. Pressure $P_2$ should be slightly higher than pressure $P_1$, preferably at least 4 psi although higher or lower differentials may be utilized in order to assure proper operation of valve 32. It should be noted, however, that the compressed air pressure must be less than twice the inlet pressure $P_1$ of the solvent so as to avoid the possibility of sonic flow within valve 42. While as described above the solvent supply is connected to inlet 48, it is possible to connect the air supply to this inlet if desired in which case the solvent pressure should be slightly higher than the air pressure.

Solvent will flow through passage 56 into chamber 58 and then through the metering orifice defined by overlapping openings 62 and 66 and into discharge chamber 100.

Additionally, the pressure Pl of the solvent will be communicated to and act against the right end surface of spool valve 70 via passage 92, grooves 80 and 94, passages 79 and 86 and the opening in orifice insert 88. The force resulting from this pressure Pl will tend to urge spool valve to the left as seen in FIG. 2.

Compressed air will flow through passage 96 across the variable orifice defined by reduced diameter portion 77 and the opening of passage 98, through passage 98, through the metering orifice defined by overlapping openings 62 and 66, and into discharge chamber 100 where it will mix with the solvent and exit via discharge port 102. A pressure drop will occur as the compressed air flows across the variable orifice such that the compressed air will have a pressure P3 at passage 98. This pressure will be communicated to and act against the left end surface of spool valve 70 via passages 78 and 84 and the opening in orifice insert 90 so as to urge spool valve to the right as shown in FIG. 2. As the opposite end surfaces of spool valve 0 are substantially identical in size, it will move either to the right or left as viewed in FIG. 2 so as to thereby modulate the pressure drop across the variable orifice until such time as pressure P3 is equal to pressure Pl Thereafter any variations in either inlet pressures Pl or P2 will result in a repositioning of spool valve 70 and hence a modulation of the pressure drop across the variable orifice such that P3 will once again be equal to Pl As each of the fixed orifices defined by overlapping openings 62, 66 and 62,, 66, open into a common discharge chamber 100 and are thus subject to the same fluid back pressure and $P_3$ is equal to $P_1$ immediately upstream therefrom, the flow volume thereacross will be directly proportional to the open area of the respective orifices. Hence, they may be easily and conveniently set by rotating orifice plates 64 and 64' to provide for the desired mixing ratio of solvent and compressed air. Once this desired ratio has been set, retaining rings 68 and 68' may be tightened so as to securely lock respective orifice plates 64 and 64' in position relative to orifice plates 60 and 60' whereupon end plate 104 may be secured to housing 44.

The intermixed solvent and air will exit via passage 102 entering the central passage of the manifolded valves 24 flow through supply line 18, manifold 16 and spray guns 14 thereby effecting a through cleaning thereof. Because both solvent and compressed air are admitted to the system simultaneously and a substantially smaller volume of solvent is required, the time required to effect a complete and thorough purging of the system is substantially reduced thus allowing for a more rapid cycle time between application of successive different coatings. Initial testing has shown that solvent usage can be reduced to about one sixth of that required with the prior method of alternating solvent and compressed air. This solvent usage reduction is a significant advantage in helping such painting or coating operations to meet the increasingly restrictive requirements imposed by the various governmental agencies.

Once the desired quantity of intermixed solvent and air required for cleaning of the system has been passed therethrough, valve 36 will close thereby stopping the flow of solvent from supply 34. However, valve 40 will preferably remain open for a short additional time frame whereby additional compressed air alone may be passed through the system to clear any remaining solvent therefrom thus producing the possibility of dilution of the next paint color or coating to be applied.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

I claim:

1. A method for cleaning the flow paths of an automated spray coating apparatus, said apparatus being adapted to apply different coatings in succession, said method comprising:

providing a pressurized source of a suitable cleaning solvent, providing a supply of compressed gas, simultaneously opening control valves to allow flow of said solvent and said compressed gas to a ratio mixing valve, controlling the flow of said compressed gas relative to the flow of said solvent by means of said ratio mixing valve to maintain a substantially constant predetermined ratio therebetween without regard to variations in pressures of said compressed gas and said pressurized source of cleaning solvent, intermixing said solvent and compressed gas in said predetermined ratio, and passing said intermixed solvent and gas through said flow paths of said spray coating apparatus.

2. A method as set forth in claim 1 wherein said gas is compressed air.

3. A method as set forth in claim 1 wherein said solvent is supplied at a first pressure within a first predetermined range and said gas is supplied at a pressure within a second predetermined range, said second predetermined range being greater than said first predetermined range.

4. A method as set forth in claim 1 wherein said solvent control valve is closed prior to closing of said compressed gas control valve whereby said compressed gas may evacuate remaining solvent from said flow paths.

* * * * *